United States Patent [19]

Tsuchiya et al.

[11] Patent Number: 4,515,112

[45] Date of Patent: May 7, 1985

[54] ALUMINUM ALLOY CYLINDER BLOCK

[75] Inventors: Yasuhiro Tsuchiya; Hitoshi Ozawa, both of Shizuoka, Japan

[73] Assignee: Toyota Jidosha Kabushiki Kaisha, Toyota, Japan

[21] Appl. No.: 426,077

[22] Filed: Sep. 28, 1982

[30] Foreign Application Priority Data

Oct. 28, 1981 [JP] Japan ..... 56-172466

[51] Int. Cl.[3] ..... F02F 7/00; F02F 1/06

[52] U.S. Cl. ..... 123/41.84; 123/193 R; 123/195 S; 123/195 R

[58] Field of Search ..... 123/41.72, 41.74, 41.81, 123/41.84, 195 A, 195 C, 195 H, 195 HC, 195 R, 195 S, 193 C, 193 R, 73 R, 73 A, 73 B, DIG. 6, DIG. 7, DIG. 1

[56] References Cited

U.S. PATENT DOCUMENTS

| | | | |
|---|---|---|---|
| 1,764,739 | 6/1930 | Meyer | 123/41.84 |
| 1,968,110 | 7/1934 | Walker | 123/41.72 |
| 2,058,528 | 10/1936 | Thege et al. | 123/41.84 |
| 2,129,906 | 9/1938 | Brill | 123/41.84 |
| 2,681,054 | 6/1954 | Boghossian | 123/195 R |
| 2,838,038 | 6/1958 | Seifert et al. | 123/195 S |
| 3,173,407 | 3/1965 | Sampietro et al. | 123/41.81 |
| 3,977,385 | 8/1976 | Mansfield | 123/195 R |
| 4,175,503 | 11/1979 | Ernest | 123/41.74 |

*Primary Examiner*—Craig R. Feinberg
*Assistant Examiner*—David A. Okonsky
*Attorney, Agent, or Firm*—Kenyon & Kenyon

[57] ABSTRACT

An aluminum alloy cylinder block for use in a water-cooled internal combustion engine has a cylinder with a bore into which a piston is to be movably fitted. A water jacket provided on the outer side wall of the cylinder is adapted to allow the passage of water therein for cooling the engine. The depth of the water jacket from the top of the cylinder block is preferably from 0.2 to 0.5 times the length of the cylinder. A crank case has a side wall connected to the bottom of the water jacket, and a cylinder rib extends from the inside of the side wall of the crank case toward the water jacket.

15 Claims, 11 Drawing Figures

PRIOR ART

A: Aluminum alloy cylinder block of the present invention.

B: Aluminum alloy cylinder block with the same structure as cast iron cylinder block.

C: Cast iron cylinder block.

ALUMINUM ALLOY CYLINDER BLOCK

BACKGROUND OF THE INVENTION (1) Field of the Invention

The present invention relates to an aluminum alloy cylinder block. More specifically, the invention relates to a design for minimizing thermal distortion of an aluminum alloy cylinder block for use in an internal combustion engine.

(2) Prior Art

It is known that a reduction in engine weight can be attained most effectively by making an engine cylinder block of aluminum alloy instead of cast iron. If the aluminum alloy cylinder block duplicates the usual structure of a cast iron cylinder block, however, this change in material brings about various unfavorable results because the coefficient of thermal expansion of aluminum is twice as large as that of cast iron.

FIG. 1 is a sectional view of a conventional cast iron cylinder block with a cylinder 2 in which no special structure other than a water jacket 3 surrounding the outer periphery of the cylinder is provided to suppress the thermal deformation of a bore inside of the cylinder.

In particular, an aluminum alloy cylinder block with such a conventional structure will suffer from a large consumption of oil because the expansion of the cylinder bores after warming-up of the engine becomes twice as large as that in the case of the same cylinder block made of cast iron.

Furthermore, the greater the dimensional difference in the cylinder block between cooled and heated states, the more difficult it is to set an appropriate clearance between the bores and pistons to avoid scuffing, seizing or the like.

For the purpose of resolving such drawbacks, there have been proposed an arrangement in which a ring of a low expansion coefficient material is cast into the circumference of the cylinder and an arrangement in which a belting means is wound around the cylinder so as to restrain the deformation of the bore. However, both these arrangements are difficult to manufacture and result in high production costs.

SUMMARY OF THE INVENTION

An object of the present invention is, therefore, to provide an aluminum alloy cylinder block free from the above mentioned drawbacks.

More specifically, the principal object of the present invention is to provide an aluminum alloy cylinder block in which thermal deformation of the cylinder bores is restrained to almost the same level as in the case of a conventional cast iron cylinder block, thereby lowering consumption of oil and diminishing scuffing and seizing between the bores and pistons.

Still another object of the present invention is to provide an aluminum alloy cylinder block having such a structure as to reinforce the mechanical strength of the upper and/or lower portion of the cylinder block.

A further object of the present invention is to provide an aluminum alloy cylinder block which provides reduced thermal deformation between the adjacent cylinders of a multicylinder engine.

Still another object of the present invention is to provide an aluminum alloy cylinder block which is simple in structure and easy to manufacture.

The present invention is characterized in that a cylinder rib is provided extending from the inner wall of the crank case to each cylinder cylinder. In addition, preferably the depth of a water jacket from the upper end of the cylinder block is designed to extend from 0.2 to 0.5 times as long as the length of the cylinder. Further, in the present invention, a horizontal rib having a length of from 0.6 to 1.0 times as long as the length of the cylinder block may be provided on the lower side wall of the cylinder block. In addition, a transverse rib may be provided bridging a depression or groove between adjacent cylinders, and also a vertical rib having a length more than 0.2 times the height of the cylinder block may be provided on the outer wall of the cylinder block and along a cylinder head bolt hole.

BRIEF DESCRIPTION OF THE DDRAWINGS

The above and other objects and advantages of the present invention will be apparent from the following detailed description in conjunction with the attached drawings, in which.

DETAILED DESCRIPTION OF THE PREFERRED EMBODIMENT

Figure 1:
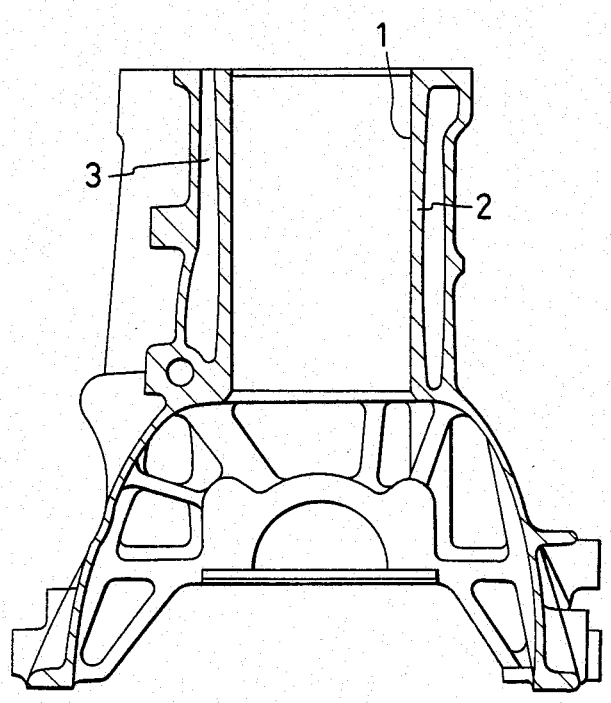
FIG. 1 is a transverse sectional view of a conventional cast iron cylinder block.
Figure 2:
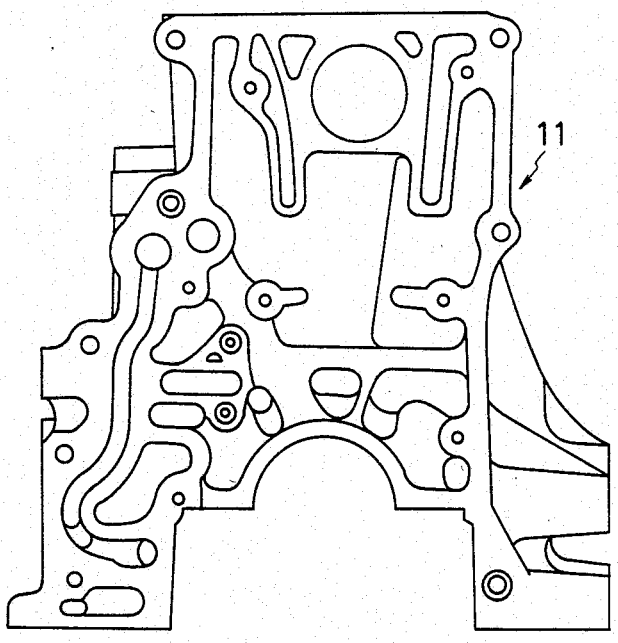
FIG. 2 is a front view of an embodiment of a cylinder block according to the present invention.

Preferred embodiments according to the present invention will be explained with reference to the drawings, especially in connection with FIGS. 2 through 8. These are merely illustrative and are not intended to limit the scope of the present invention.

An aluminum alloy cylinder block 11 has a cylinder 12 with a bore 16 into which a piston (not shown) is to be slidably fitted. The upper outer walls 21, 22 of the cylinder block form a water jacket 13 which is adapted to circulate water for cooling the block. The depth (l) of the water jacket is from 0.2 to 0.5 times, preferably from 0.3 to 0.45 times, the length (L) of the cylinder 12 (see FIG. 5). A crank case 14 has an outer wall 23 that extends up to the cylinder 12 at an appropriate location or locations under the water jacket.

At least one vertical cylinder rib 15 extends transversely of the longitudinal axis of the cylinder block between the crank case outer wall 23 and the cylinder of each cylinder. The thickness of the cylinder rib is from 3 to 8 mm and preferably from 4 to 6 mm.

Figure 5:
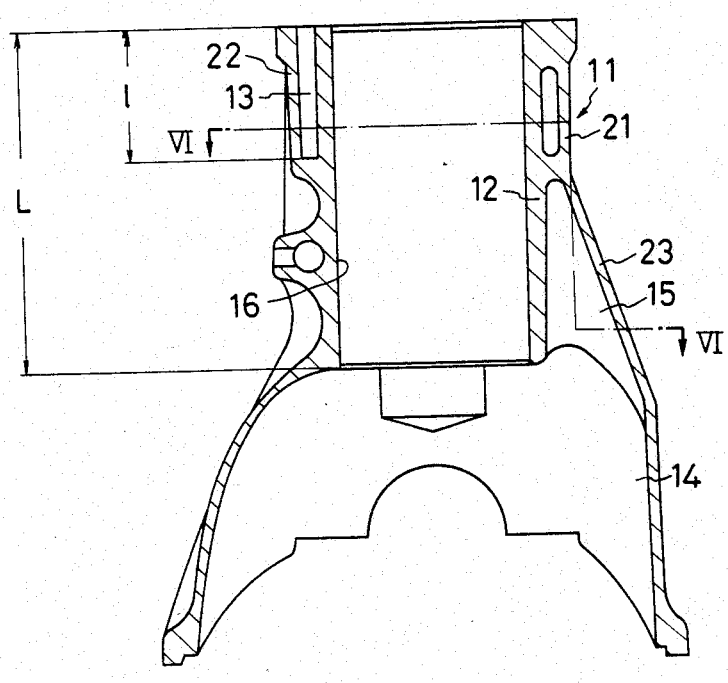
FIG. 5 is a sectional view of the cylinder block taken along the line V—V in FIG. 4.
Figure 6:
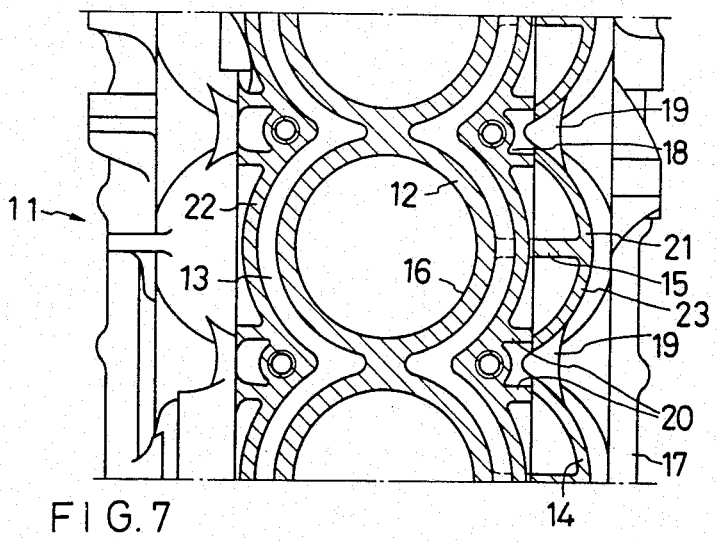
FIG. 6 is a partial sectional view of the cylinder block taken along the line VI—VI in FIG. 5.
Figure 7:
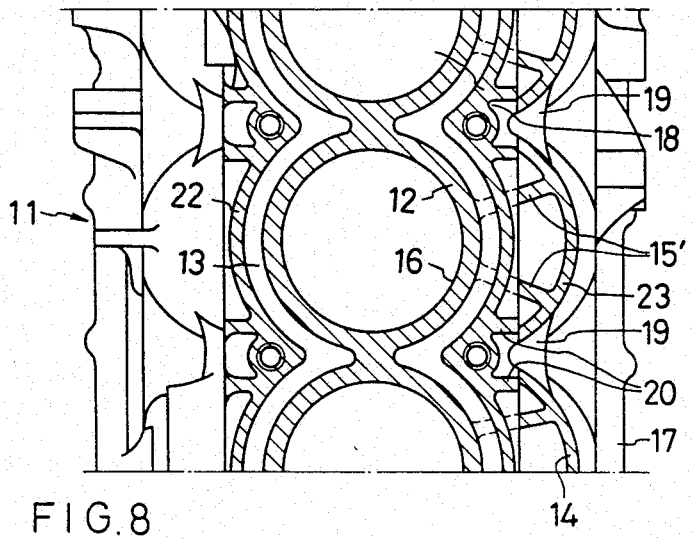
FIG. 7 is a view similar to that of FIG. 6 of an alternative embodiment of the cylinder block.
Figure 8:
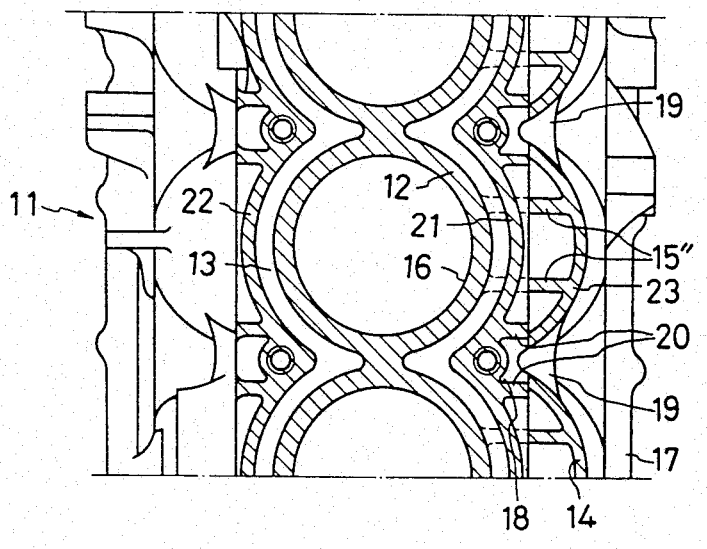
FIG. 8 is a view similar to that of FIG. 6 of another alternative embodiment of the cylinder block.

When singly applied, as shown in FIG. 6, the cylinder rib 15 meets the cylinder in such a way that the extension of the liner rib passes through the center axis of the cylinder. In case two cylinder ribs are to be applied, it is desirable that the cylinder ribs be positioned respectively on opposite sides of a plane passing through the center line of each cylinder and orthogonal to the longitudinal axis of the cylinder block, and that the cylinder ribs be equally spaced from this plane. As shown in FIG. 8, cylinder ribs 15" may be parallel to this plane, or as shown in FIG. 7, the extensions of the cylinder ribs 15' may intersect with each other substantially at the center axis of the cylinder while making equal angles of less than 30° with respect to the above plane. In case the ribs are positioned parallel to the plane, the distance between the plane and each rib is preferably less than 0.25 times the diameter of the bore. It is preferable that the cylinder rib runs from the liner to the outside wall of the crank case in a straight line or in a round curve. In FIG. 6, only a single cylinder rib in section is shown. Although the upper end of the cylinder rib 15 is shown in FIG. 5 as extending up to the lower end wall of the water jacket, it is not necessary that it do so.

By constructing the water jacket and cylinder rib as described above, the thermal stresses of the cylinder 12 are transferred directly to the water jacket and the cylinder rib, so that thermal distortion of the bore 16 and the thermal longitudinal expansion of the cylinder can be held to a small amount. Furthermore, the water circulating in the water jacket serves to cool down the upper portion of the cylinder, which is heated up to a relatively high temperature; whereas the heat in the lower portion of the cylinder, which is heated up to a relatively low temperature, is dissipated through the cylinder rib 15. Thereby, the temperature of the cylinder block can be kept as constant as possible, and the thermal deformation of the inner diameter of the bore 16 and the thermal expansion of the cylinder is its vertical direction can be held to a minimum.

Figure 3:
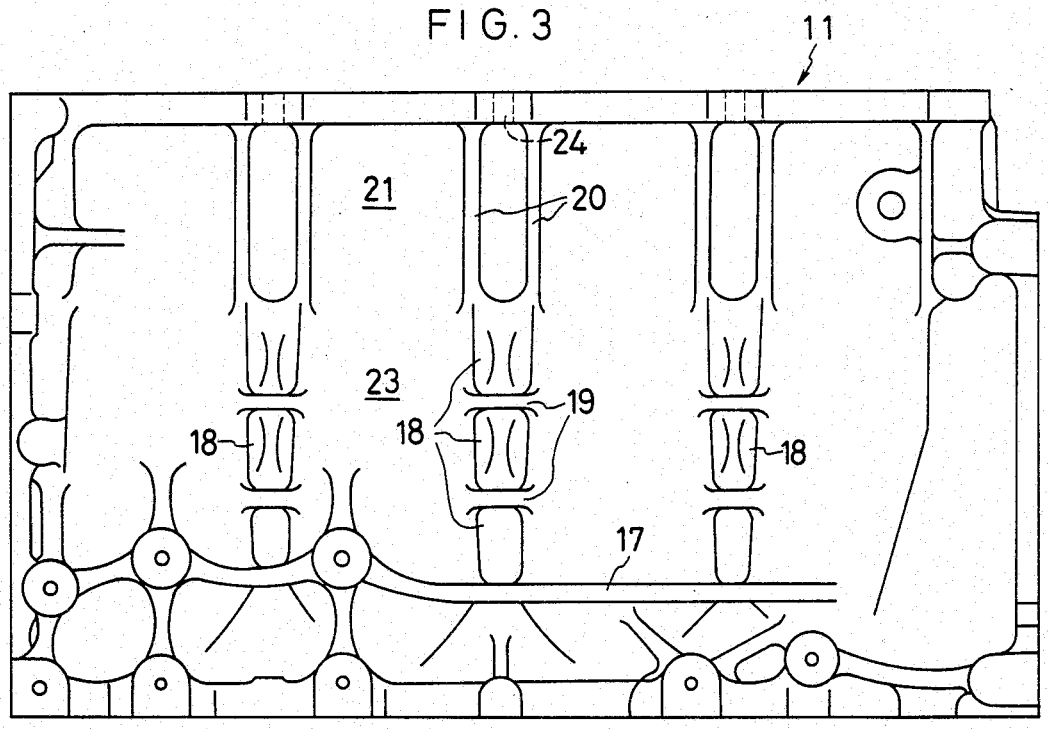
FIG. 3 is a view of the left side of the cylinder block shown in FIG. 2.
Figure 4:
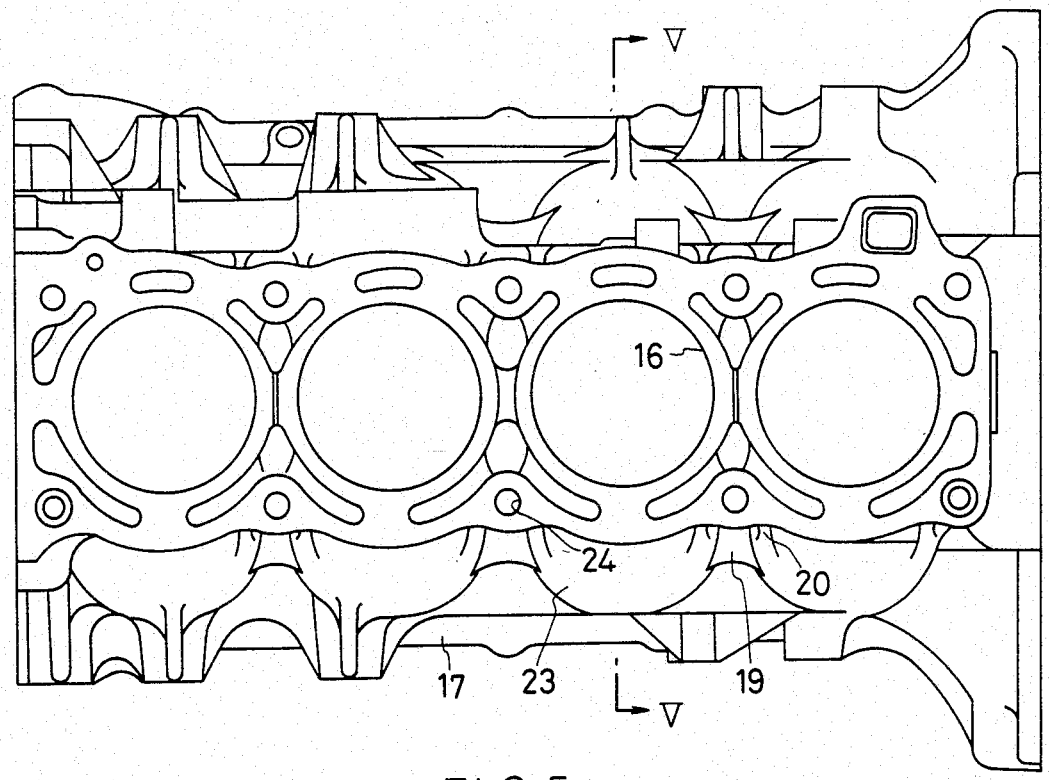
FIG. 4 is a plan view of the cylinder block shown in FIG. 2.

Further, according to the present invention, as shown in FIG. 3, on the side wall 23 of the crank case is provided a horizontal longitudinal rib 17 at a place from 0.2 to 0.6 times, preferably from 0.2 to 0.3 times, the height of the cylinder block from the bottom thereof. The length of the horizontal rib 17 is from 0.6 to 1.0 times, preferably from 0.8 to 1.0 times the length of the cylinder block. Although a single horizontal longitudinal rib 17 is shown in FIG. 3, it is not restrictive; there may be two or more horizontal longitudinal ribs, if desired.

Moreover, as illustrated in FIG. 3, a vertical depression or a groove 18 is provided in outer walls 21 and 23 between adjacent cylinders, and two horizontal transverse ribs 19 bridge between opposite walls of each depression. Although two transverse ribs are shown in FIG. 3, this is not restrictive, and two or more horizontal transverse ribs may be used.

The horizontal longitudinal rib 17 enhances the rigidity of the lower portion of the cylinder block 11 and reinforces the cylinder ribs 15, whereas the depressions 18 and the horizontal transverse ribs 19 suppress thermal deformation between the adjacent cylinders.

The upper portion of the cylinder block is provided with a plurality of cylinder head bolt holes 24, which are used for securing the cylinder head to the cylinder block. As shown in FIG. 3, two vertical ribs 20 are provided extending from the top of the cylinder block on the outer side wall 21 of the cylinder block along each cylinder head bolt hole. The length of each vertical rib 20 is more than 0.2 times, preferably from 0.4 to 0.8 times, the height of the cylinder block. In this embodiment, the number of vertical ribs between adjacent cylinders is two, but it may be one, if desired. The vertical ribs 20 enhance the rigidity of the upper portion of the cylinder block 11 and minimize distortion of the cylinder 12 which may be caused by tightening the cylinder head bolts.

The vertical depression or groove 18 is formed below the ribs 20. In case the number of ribs 20 between adjacent cylinders is two, the depression or groove 18 may extend upward between them.

Figure 9:
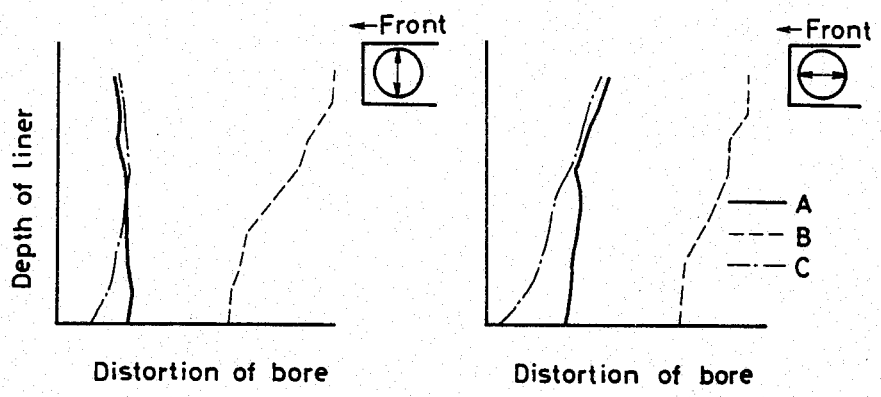
FIG. 9 is a diagram illustrating the relationship between the diametral distortion and depth of a cylinder bore when hot water is circulated in a water jacket of each of three different cylinder blocks.
Figure 10:
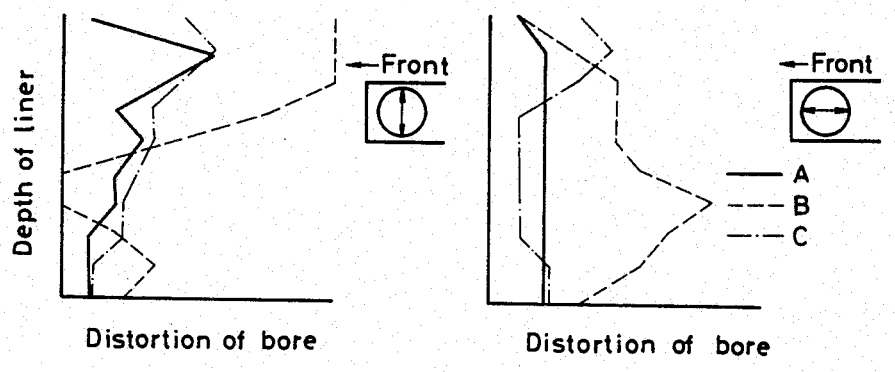
FIG. 10 is a diagram illustrating the relationship between the diametral distortion and depth of the bore when a cylinder head is tightly bolted to each cylinder block referred to in FIG. 6.
Figure 11:
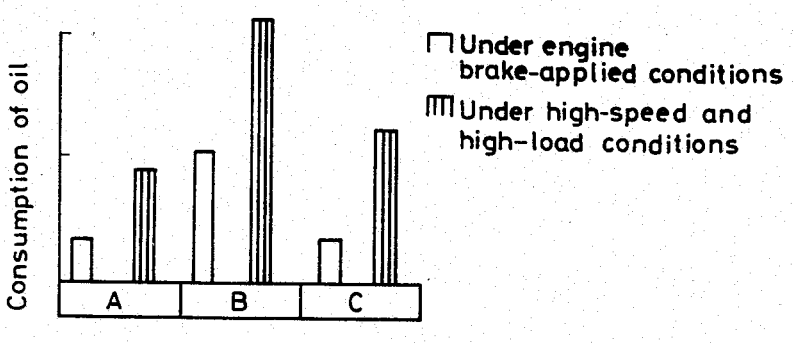
FIG. 11 is a diagram illustrating oil consumption of engines incorporating the cylinder blocks referred to in FIG. 6.

FIGS. 9 to 11 are diagrams illustrating test results with respect to a conventional type cast iron cylinder block, an aluminum alloy cylinder block with the same structure as the conventional cast iron cylinder block, and an aluminum alloy cylinder block according to the present invention. The tests were conducted using 2000 cc gasoline engines.

FIG. 9 shows the distortion of each bore when hot water is circulated. From this figure, it is seen that although the cylinder block according to the present invention is made of aluminum alloy, its distortion is kept to the distortion levels of the cast iron cylinder block both parallel and perpendicular to the longitudinal axis of the block.

In FIG. 10, illustrating the distortion of the bore when the cylinder head is tightly assembled onto the cylinder block, it is seen that the distortion of the bore of the cylinder block according to the present invention is held to the level of the cast iron cylinder block both parallel and perpendicular to the longitudinal axis of the block.

In FIG. 11, illustrating oil consumption, it is seen that the cylinder block according to the present invention has no more oil consumption than the cast iron one both under engine brake application and under high-speed and high-load conditions.

As an aluminum alloy in the present invention, for instance, an Al-Si based alloy can be employed. The surface of the bore is treated by honing to produce a surface roughness of 0.8 to 5 RZ, preferably 1 to 3 RZ.

The aluminum alloy cylinder block according to the present invention can be manufactured, for instance, by die casting or by low pressure casting.

As mentioned above, in the present invention, the depth of the water jacket from the upper end of the cylinder block is designed preferably to be from 0.2 to 0.5, preferably 0.3 to 0.45, times the length of the cylinder, and the cylinder rib extends from the side wall of the crank case to the cylinder. Therefore, the upper portion of the cylinder, which is heated up to higher temperatures, is adapted to be cooled by water circulating in the water jacket, while the heat is dissipated via the liner rib in the lower portion of the cylinder, which stays at relatively lower temperatures.

Furthermore, the thermal deformation of the cylinder is directly exerted upon the water jacket and the cylinder rib. Thus, according to the present invention, the cylinder block can be easily manufactured with a slight change in the conventional structure, the distortion of the bore can be held to the level of the cast iron cylinder block, oil consumption can be reduced, and scuffing and seizure between the bore and the piston can be effectively prevented.

Furthermore, distortion of the bore is reduced and the rigidity of the cylinder block as a whole is improved by providing at least one horizontal longitudinal rib which has from 0.6 to 1.0 times the length of the cylinder block on the side wall of the crank case at a location from 0.2 to 0.6 times the height of the cylinder block from the bottom thereof, a depression or groove on the side wall of the cylinder block between adjacent cylinders, at least two horizontal transverse ribs bridging between the opposite side walls of the depression or groove, and one or two vertical ribs on the outer side wall of the cylinder block per cylinder head bolt hole, which vertical ribs are at least 0.2 times the height of the cylinder block.

It should be understood by those skilled in the art that the foregoing description is of preferred embodiments of the disclosed device and that various changes and modifications may be made in the invention without departing from the spirit or the scope thereof.

We claim:

1. An aluminum alloy cylinder block for use in a water-cooled internal combustion engine, said cylinder block having a longitudinal axis and comprising:

a plurality of cylinders formed integrally with the block and disposed in a row, each cylinder having an integral bore into which a piston is to be movably fitted, each bore having a center axis which intersects the longitudinal axis of the cylinder block, and each cylinder having an upper end where combustion occurs and a lower end;

a water jacket provided around the upper end of each cylinder, said water jacket being adapted to allow passage of water therein for cooling the upper end of the cylinder and having an outer side wall and a lower end wall integral with the cylinder, the lower end wall being spaced from the upper end of the cylinder by 0.2 to 0.5 times the length of the cylinder from the upper end to the lower end;

a crankcase having an outer side wall connected to and formed integrally with the lower end wall of the water jacket, said outer side wall having an inside surface spaced from the cylinders and an outside surface;

at least one cylinder rib extending downwardly from the lower end wall of the water jacket and outwardly from the lower end of each cylinder to the inside surface of the outer side wall of the crankcase being integrally formed with each of said lower end wall of the water jacket, lower end of each cylinder and the inside surface of the outer side wall of the crankcase for dissipating heat from the lower end of the cylinder below the water jacket and for increasing the rigidity of the engine, said at least one rib intersecting the corresponding cylinder at a line parallel to the center axis of the cylinder and located at a distance of not more than one quarter of a diameter of the cylinder bore from a plane containing the center axis of the cylinder and perpendicular to the longitudinal axis of the cylinder block.

2. An aluminum alloy cylinder block of claim 28, wherein the cylinder rib lies on a plane passing through the center axis of the cylinder and perpendicular to the front-to-rear axis of the cylinder block.

3. An aluminum alloy cylinder block of claim 1, wherein the number of the cylinder ribs for each cylinder is two, each cylinder rib making a same angle with respect to a plane perpendicular to the longitudinal axis of the cylinder block and passing through the center axis of the corresponding cylinder, and the extension of the cylinder ribs pass through the center axis of the corresponding cylinder.

4. An aluminum alloy cylinder block of claim 1, wherein said at least one cylinder rib comprises two cylinder ribs parallel to each other and the same distance away from a plane perpendicular to the longitudinal axis of the cylinder block and passing through the center axis of the corresponding cylinder, said distance being less than one quarter of a diameter of the cylinder bore.

5. An aluminum alloy cylinder block of claim 1, wherein a depression is provided on the outer side wall of the water jacket between two adjacent cylinders, and two horizontal ribs are bridged between opposite walls of the depression.

6. An aluminum alloy cylinder block of claim 1, further comprising a vertical rib provided on the outer side wall of the water jacket alongside of a hole provided in an upper end of the cylinder block for securing a cylinder head to the cylinder block.

7. An aluminum alloy cylinder block of claim 6, wherein a depression is provided on the outer side wall of the water jacket between two adjacent cylinders, and two horizontal ribs are bridged between opposite walls of the depression.

8. An aluminum alloy cylinder block of claim 6, wherein a length of the vertical rib from the upper end of the cylinder block is more than 0.2 times a total height of the cylinder block.

9. An aluminum alloy cylinder block of claim 8, wherein a depression is provided on the outer side wall of the water jacket between two adjacent cylinders, and two horizontal ribs are bridged between opposite walls of the depression.

10. An aluminum alloy cylinder block of claim 1, further comprising a horizontal rib provided on the outer side wall of the crank case, said horizontal rib being situated at a height of from 0.2 to 0.6 times a total height of the cylinder block from a bottom thereof and having a length from 0.6 to 1.0 times a total longitudinal dimension of the cylinder block.

11. An aluminum alloy cylinder block of claim 10, wherein a depression is provided on the outer side wall of the water jacket between two adjacent cylinders, and two horizontal ribs are bridged between opposite walls of the depression.

12. An aluminum alloy cylinder block of claim 10, further comprising a vertical rib provided on the outer side wall of the water jacket alongside of a hole provided in an upper end of the cylinder block for securing a cylinder head to the cylinder block.

13. An aluminum alloy cylinder block of claim 12, wherein a depression is provided on the outer side wall of the water jacket between two adjacent cylinders, and two horizontal ribs are bridged between opposite walls of the depression.

14. An aluminum alloy cylinder block of claim 12, wherein a length of the vertical rib from the upper end of the cylinder block is more than 0.2 times the total height of the cylinder block.

15. An aluminum alloy cylinder block of claim 14, wherein a depression is provided on the outer side wall of the water jacket between two adjacent cylinders, and two horizontal ribs are bridged between opposite walls of the depression.

* * * * *

UNITED STATES PATENT AND TRADEMARK OFFICE

CERTIFICATE OF CORRECTION

PATENT NO. : 4,515,112

DATED : May 7, 1985

INVENTOR(S) : Y. Tsuchiya et al.

It is certified that error appears in the above-identified patent and that said Letters Patent is hereby corrected as shown below:

Column 3, line 5, change "liner" to --cylinder--.

Column 3, line 41, change "is" to --in--.

Signed and Sealed this

*Thirteenth* Day of *August 1985*

[SEAL]

*Attest:*

DONALD J. QUIGG

*Attesting Officer* *Acting Commissioner of Patents and Trademarks*